US009751186B2

(12) United States Patent
Sperl et al.

(10) Patent No.: US 9,751,186 B2
(45) Date of Patent: Sep. 5, 2017

(54) BATTERY-OPERATED ECCENTRIC SANDER HAVING AN ELECTRONICALLY COMMUTATED ELECTRIC MOTOR

(71) Applicant: Robert Bosch GmbH, Stuttgart (DE)

(72) Inventors: Michael Sperl, Pluederhausen (DE); Florian Esenwein, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 432 days.

(21) Appl. No.: 14/498,549

(22) Filed: Sep. 26, 2014

(65) Prior Publication Data

US 2015/0083450 A1 Mar. 26, 2015

(30) Foreign Application Priority Data

Sep. 26, 2013 (DE) ..... 10 2013 219 450

(51) Int. Cl.
*B24B 23/03* (2006.01)
*B24B 55/10* (2006.01)

(52) U.S. Cl.
CPC ..... *B24B 23/03* (2013.01); *B24B 55/102* (2013.01)

(58) Field of Classification Search
CPC ..... B24B 23/028; B24B 23/03; H02K 11/00
USPC ..... 173/46, 67, 90, 217
See application file for complete search history.

(56) References Cited

U.S. PATENT DOCUMENTS 4,624,078 A * 11/1986 Van Rijen ..... B24B 55/105 451/357
4,897,847 A * 1/1990 Wolgast ..... H01S 3/022 372/101
5,564,969 A * 10/1996 Tsang ..... B24B 23/02 451/344
6,394,884 B1 * 5/2002 Wuensch ..... B24B 23/022 451/354
6,454,640 B1 * 9/2002 Siedler ..... B24B 23/02 451/357
D471,329 S * 3/2003 Heun ..... D32/15
D525,752 S * 7/2006 Bakker ..... D32/19
7,270,591 B2 * 9/2007 Deshpande ..... B24B 23/03 451/357
2009/0275273 A1 * 11/2009 Purohit ..... B24B 23/03 451/357
2009/0280732 A1 * 11/2009 Esenwein ..... B24B 23/028 451/359

(Continued)

*Primary Examiner* — Nathaniel Chukwurah
(74) *Attorney, Agent, or Firm* — Maginot, Moore & Beck LLP

(57) ABSTRACT

A battery-operated hand power tool, in particular an eccentric sander, includes at least one electronically commutated electric motor that acts upon an output shaft and that is configured to drive a working tool. The hand power tool further includes at least one motor housing part that accommodates the electronically commutated electric motor. The electronically commutated electric motor and the output shaft define a common first axis that is coaxial with the output shaft. At least one handle region of the hand power tool accommodates at least one set of electronics configured to energize the electronically commutated electric motor. The motor housing part and the handle region are disposed at an angle to each other. The working tool has a diameter that is between 75 and 150 mm, but preferably is between 115 and 125 mm.

19 Claims, 3 Drawing Sheets

(56) References Cited

U.S. PATENT DOCUMENTS

2012/0135671 A1* 5/2012 Klabunde ..... B24B 55/10
451/358

* cited by examiner

BATTERY-OPERATED ECCENTRIC SANDER HAVING AN ELECTRONICALLY COMMUTATED ELECTRIC MOTOR

This application claims priority under 35 U.S.C. §119 to patent application no. DE 10 2013 219 450.1, filed on Sep. 26, 2013 in Germany, the disclosure of which is incorporated herein by reference in its entirety.

BACKGROUND

The disclosure relates to a battery-operated eccentric sander having an electronically commutated electric motor.

SUMMARY

The battery-operated hand power tool according to the disclosure has the advantage of being particularly compact and powerful while, at the same time, being ergonomically easy to handle. At least one electronically commutated electric motor, which acts upon an output shaft, is provided to drive a working tool. A motor housing part accommodates the electronically commutated electric motor. Advantageously, the electronically commutated electric motor and the output shaft constitute a first axis, which is coaxial with the output shaft. At least one set of electronics, provided to energize the electronically commutated electric motor, is accommodated by a handle region. A handle region is to be understood to mean, in particular, a region of the hand power tool that is used as a handle by an operator. The term "handle" is to be understood to mean a component around which a hand of an operator of the battery-operated hand power tool may be placed for the purpose of guiding the hand power tool. Advantageously, the motor housing part and the handle region are disposed at an angle to each other. The output shaft, via an eccentric mounting, drives a carrier shaft of a working tool of the battery-operated hand power tool. In the embodiment according to the disclosure, the working tool is, for example, a backing pad.

It is proposed that the working tool of the battery-operated hand power tool has a diameter d that is between 75 and 150 mm, but preferably between 115 and 125 mm. Advantageously, a working tool of this size makes it possible to achieve precise working with the battery-operated hand power tool.

In the case of comfortable hand power tools of this type it is possible, for various removal rates, to select between two operating modes. In free-running mode, the axis of the working tool of the battery-operated hand power tool executes an eccentric motion. By contrast, when driven in a constrained manner, the axis of the working tool is additionally driven, for a high removal rate.

The features stated in the dependent claims provide for advantageous developments of the battery-operated hand power tool.

In a particularly advantageous embodiment of the battery-operated hand power tool according to the disclosure, a height of the motor housing part is reduced. A measure of the compactness of the battery-operated hand power tool is defined by a ratio of the height h along the first axis of the motor housing part to a diameter d of the working tool of the battery-operated hand power tool. Advantageously, the ratio of the height h along the first axis of the motor housing part to a diameter d of the working tool of the battery-operated hand power tool is less than or equal to 1.15, in particular less than 1.0, but preferably less than 0.9. The battery-operated hand power tool is thus of a compact design, and easy for an operator to handle.

Advantageously, the height h of the first housing part along the first axis is between 90 and 135 mm, in particular between 100 and 120 mm, but preferably between 105 and 110. The compact design is realized, inter alia, by the use of a particularly powerful electric motor.

A further aspect of a particularly compact battery-operated hand power tool relates to a ratio of a length l of the battery-operated hand power tool to the height h of the motor housing part. In a particularly advantageous embodiment, the ratio of the length l of the battery-operated hand power tool to the height h of the motor housing part is between 1.8 and 2.2. Particularly preferably, however, the ratio of the length l of the battery-operated hand power tool to the height h of the motor housing part is 2. This ratio is possible because of the compact design of the battery-operated hand power tool. If the length l of the battery-operated hand power tool is only twice as great as the compact height of the motor housing part, a battery-operated hand power tool is realized that, from an ergonomic point of view, is particularly easy to handle.

It is likewise advantageous to select an optimum ratio of the length l of the battery-operated hand power tool to the diameter d of the working tool of the battery-operated hand power tool. Advantageously, the ratio of the length l of the battery-operated hand power tool to the diameter d of the working tool of the battery-operated hand power tool is between 1.2 and 2.8, but preferably between 1.4 and 1.8. In the said region, the hand power tool is optimal in respect of size and power. For the operator, this means a high degree of user-friendliness from an ergonomic point of view.

In an embodiment according to the disclosure, the handle region of the battery-operated hand power tool has a first grip region. A grip region is to be understood to mean a region that an operator grips with one hand in order to guide the battery-operated hand power tool. Advantageously, the first grip region has a circumference U that is between 110 and 200 mm, in particular between 125 and 185 mm, but preferably between 150 and 175 mm. One-handed operation of the battery-operated hand power tool is therefore possible in each working position.

In a particularly advantageous embodiment, according to the disclosure, of the battery-operated hand power tool, a second grip region is disposed on the motor housing part. The handle may have the form of an ergonomically shaped knob. This gives a handle that, from an ergonomic point of view, is easy to hold, and also gives the handle a pleasing visual appearance.

It is likewise advantageous to select an optimum ratio of the diameter d of the working tool of the battery-operated hand power tool to a diameter $d_1$ of the electronically commutated electric motor. Optimally, the ratio of the diameter d of the working tool of the battery-operated hand power tool to a diameter $d_1$ of the electronically commutated electric motor is less than or equal to 4.0, in particular less than 3.6, but preferably less than 3.5.

Advantageously, the electronically commutated motor is an electric motor with the tool spindle without the interposition of a conventional gearing such as, for example, a planetary gearing, bevel gearing or spur gearing. This makes it possible to achieve a compact design, combined with a high power density and low wear.

In an advantageous embodiment according to the disclosure, the electronically commutated electric motor is an internal-rotor motor. This makes it possible to achieve high rotational speeds and a high power density. In a further advantageous embodiment, the electronically commutated electric motor is an external-rotor motor. If the electronically commutated electric motor is an external-rotor motor, the electric motor drive is of a robust design and can deliver high torques from a standing start. Accordingly, such a drive is particularly suitable for applications in which high torques are required.

It is proposed that at least one fan be disposed in the first housing part. Particularly advantageously, the fan is integrated between the electronically commutated electric motor and a receiver that is provided for the working tool of the battery-operated hand power tool. Effective cooling is thus provided.

Furthermore, it is proposed to integrate at least one dust suction device in the first housing part.

Further advantages and expedient embodiments are disclosed by the description of the figures and by the drawings.

BRIEF DESCRIPTION OF THE DRAWINGS

The drawings show exemplary embodiments of a hand power tool according to the disclosure.

In the drawings.

DETAILED DESCRIPTION

Components that occur in the different exemplary embodiments are denoted by the same references.

Figure 1:
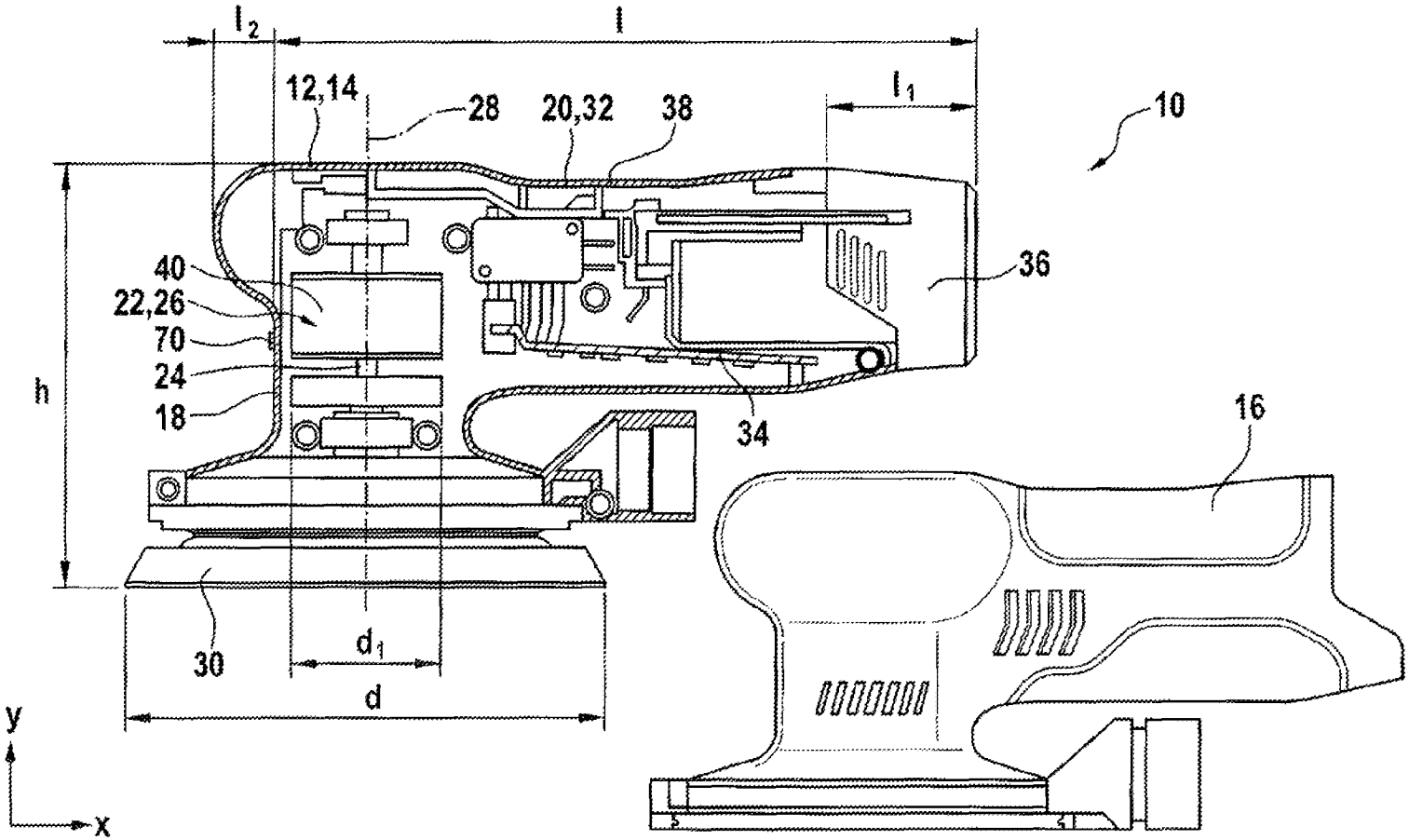
FIG. 1 shows a hand power tool according to the disclosure, in a schematic representation.

FIG. 1 shows a schematic representation of a battery-operated hand power tool 10 realized as an eccentric sander. A first housing part 12 is composed of at least one first housing half-shell 14 and one second housing half-shell 16. The first housing part 12 additionally comprises a motor housing part 18 and a handle region 20. An electric motor drive 22 is disposed in the motor housing part 18. The electric motor drive 22 is connected to an output shaft 24. The electric motor drive 22 is preferably realized as an electronically commutated electric motor 26. The electronically commutated electric motor 26 and the output shaft 24 constitute a common first axis 28. The first axis 28 is coaxial with the output shaft 24. Via an eccentrically disposed bearing, the output shaft 24 is connected to a carrier shaft, which carries a working tool 30. In the exemplary embodiment, the working tool 30 of the battery-operated hand power tool 10 is a backing pad, to the underside of which an abrasive means can be attached for working the surface of a workpiece. The working tool 36 of the battery-operated hand power tool 10 has a diameter d that is between 75 and 150 mm, but preferably between 115 and 125 mm. The bearing may be realized as a ball bearing, and enables the carrier shaft to autorotate about a rotation axis, which at the same time constitutes the rotation axis of the working tool 36. The rotation axis of the carrier shaft is parallel to the rotation axis 28 of the output shaft 24, eccentrically spaced apart therefrom.

The handle region 20 is realized as a handle 32, or is used as a handle by an operator of the battery-operated hand power tool 10. The term "handle" is to be understood to mean a component around which at least one hand of the operator may be placed for the purpose of guiding the battery-operated hand power tool 10. The motor housing part 18 and the handle region 20 are disposed at an angle to each other. Preferably, the motor housing part 18 and the handle region 20 are at an angle of approximately 90° in relation to each other. The specified angle does not take account of any production tolerances.

A set of electronics 34 is disposed in the handle region 20. The set of electronics 34 is provided to energize the electronically commutated electric motor 26. In the exemplary embodiment, the set of electronics 34 is disposed in the handle region 20. It is also conceivable, however, for the set of electronics 34 to be, for example, integrated in the electronically commutated electric motor 24 or realized separately.

A rechargeable battery 36 serves as an energy source for the electric motor drive 22.

A geometric extent of the battery-operated hand power tool 10 is defined by a height h. The height h extends along the first axis 28, in a y direction of FIG. 1.

An advantage of the battery-operated hand power tool 10 according to the disclosure is its compact design, having a low height h. The ratio of the height h along the first axis 28 of the motor housing part 18 to the diameter d of the working tool 30 of the battery-operated hand power tool 10 is less than or equal to 1.15, preferably less than 1.0, but preferably less than 0.9. In the said region, the battery-operated hand power tool 10 is of an optimum design in respect of size and power.

The height of the battery-operated hand power tool 10 is preferably between 90 and 135 mm, in particular between 100 and 120 mm, but preferably between 105 and 110.

A further geometric extent of the battery-operated hand power tool 10 is defined by a length l. The length l extends along the handle region 20, in an x direction of FIG. 1. The length l includes a visible length $l_1$ of the rechargeable battery 36. In the preferred design of the battery-operated hand power tool 10, the ratio of the length l of the battery-operated hand power tool 10 to the height h along the first axis 28 of the motor housing 18 is between 1.8 and 2.2. Preferably, however, the ratio of the length l of the battery-operated hand power tool 10 to the height h along the first axis 28 of the motor housing 18 is 2. This corresponds to a particularly small and compact battery-operated hand power tool 10.

A further measure of the compactness of the battery-operated hand power tool 10 is the ratio of the length l of the battery-operated hand power tool 10 to the diameter d of the working tool 30 of the battery-operated hand power tool 10. Preferably, the ratio of the length l of the battery-operated hand power tool 10 to the diameter d of the working tool 30 of the battery-operated hand power tool 10 is between 1.2 and 2.8, but preferably between 1.4 and 1.8.

In a preferred embodiment, the handle region 20 has a first grip region 38, which is defined by a circumference U. Since the first grip region 38 defines a region around which the hand of the operator is laid when guiding the battery-operated hand power tool 10, a particularly ergonomic design of the battery-operated hand power tool 10 is achieved by an optimum circumference U of the first grip region 38. The circumference of the first grip region 38 is preferably between 110 and 200 mm, in particular between 125 and 185 mm, but preferably between 150 and 175 mm. If the circumference U of the first grip region 38 is within this value range, the battery-operated hand power tool 10 can be guided with one hand, in each working position adopted by an operator.

In order to achieve particularly convenient guiding of the battery-operated hand power tool 10, it is advantageous to dispose a second grip region 56 on the motor housing part 18. The second grip region 56 is realized, in particular, as a knob, which also gives a pleasing visual appearance. The second grip region 56 is designed in such a manner that it lies in the operator's hand in a particularly ergonomic manner.

The second grip region 56 defines a length $l_2$, which extends from the outer casing of the second grip region 56 to a wall 70 of the motor housing part 18. The length $l_2$ is advantageously between 5 and 30 mm, in particular between 7 and 25 mm, but preferably between 10 and 20 mm.

As can be seen from FIG. 1, the electronically commutated electric motor 26 has a diameter $d_1$. The diameter $d_1$ in this case is the diameter of a motor housing 40. In the exemplary embodiment, the diameter $d_1$ is approximately 38 mm. The value does not take account of any production tolerances occurring during the motor production process. In the preferred design, the ratio of the diameter d of the working tool 30 of the battery-operated hand power tool 10 to a diameter $d_1$ of the electronically commutated electric motor 26 is less than or equal to 4.0, in particular less than 3.6, but preferably less than 3.5.

The electronically commutated electric motor 26 drives the carrier shaft directly. "Directly" is to be understood to mean that the electronically commutated electric motor 26 is connected to the carrier shaft without the interposition of a conventional gearing such as, for example a planetary gearing, bevel gearing or spur gearing.

The eccentrically disposed working tool 30 of the battery-operated hand power tool 10 executes a swinging motion. In this case, the travel that is produced thereby is twice as great as the eccentric distance between the rotation axis of the carrier shaft and the first axis 28.

Figure 2:
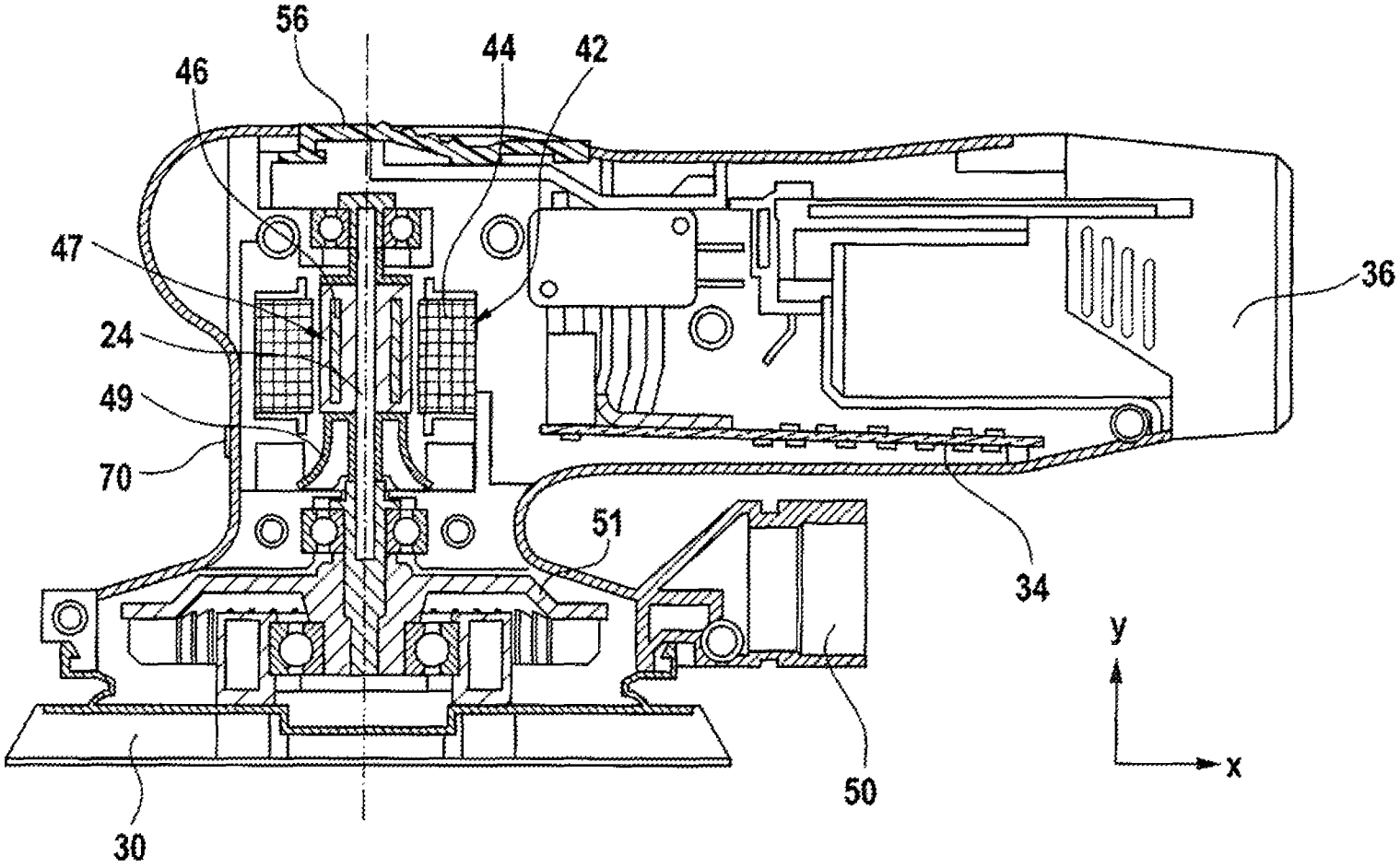
FIG. 2 shows a partial view of the hand power tool according to the disclosure, in a schematic representation.

FIG. 2 shows a partial view of the hand power tool 10 according to the disclosure, in a schematic representation.

As can be seen from FIG. 2, the electronically commutated electric motor 26 is an internal-rotor motor. In motors of this type, a stator 42, which carries the current-carrying windings 44, is located on the motor housing 40. A rotor 46, which carries the permanent magnets 47, is connected to the output shaft 24. The advantages of the internal-rotor motor are a high attainable rotational speed and, at the same time, a high power density.

Figure 3:
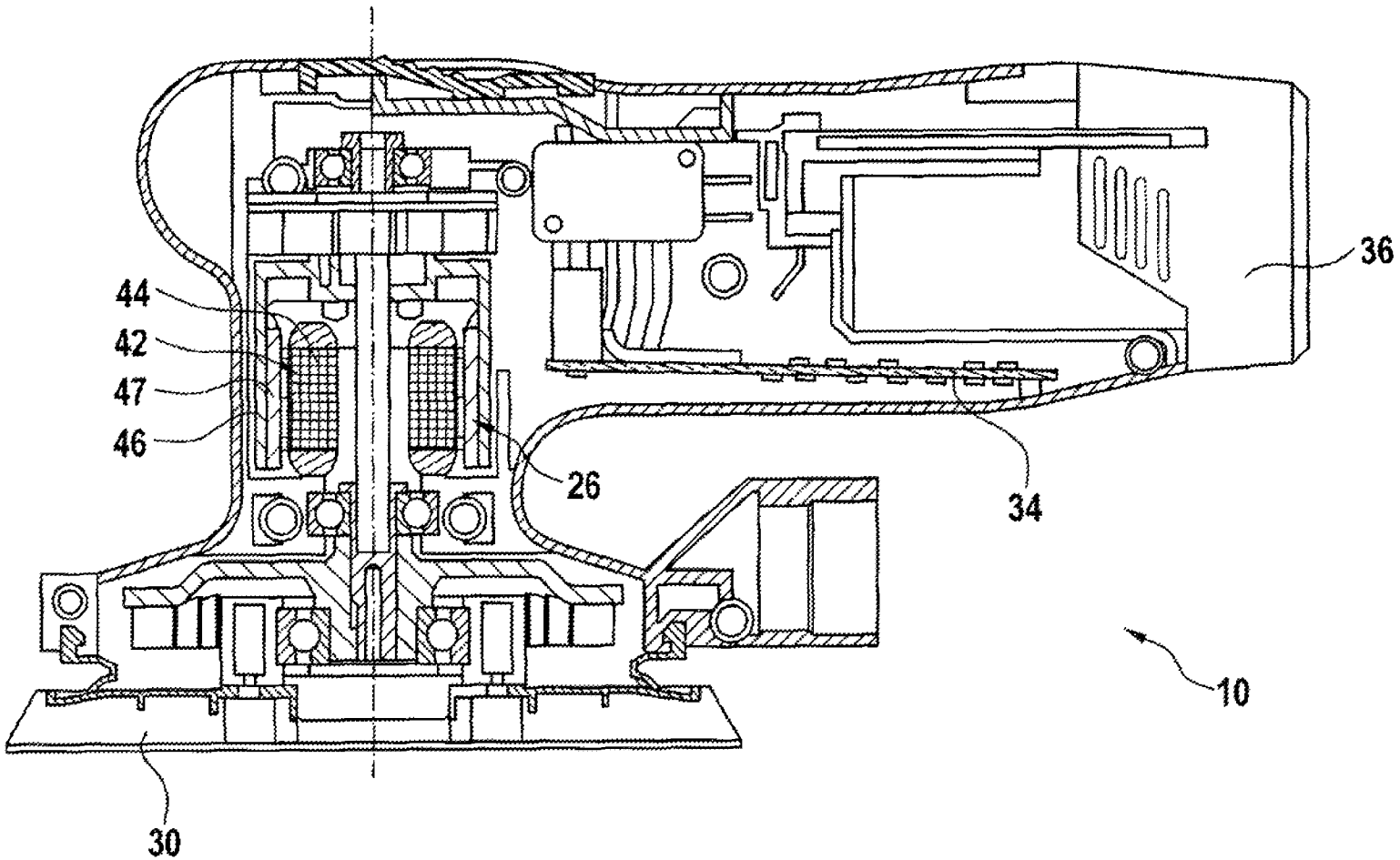
FIG. 3 shows a second exemplary of the hand power tool according to the disclosure, in a schematic representation.

A further embodiment of the battery-operated hand power tool 10 according to the disclosure is represented in FIG. 3. As can be seen from FIG. 3, the electronically commutated electric motor 26 is an external-rotor motor. In the case of motors of this type, the stator 42, which carries the windings 44, is surrounded by the rotor 46. The magnetic field is generated by permanent magnets 47, which are disposed in the rotor 46. The rotor 46 is usually attached to the output shaft 24, while the stator is disposed on a stator carrier. Possible advantages of these motors are the high attainable torques.

In the exemplary embodiments, the rotational speed is between 3000 min-1 to 15000 min-1, in particular preferably 8000 rpm to 11000 rpm. Furthermore, the rotational speed can be reduced via a positioning element.

A travel of the working tool 30 actuated by the eccentric motion of the working tool 30 is optimally between 7.0 and 2.0 mm, but preferably between 2.5 and 5.0. Particularly preferably, however, the travel of the working tool 30 is 5.0 mm.

Since in the case of hand power tools 10 having electronically commutated electric motors 26, the set of electronics 34 is designed so as to be more powerful and with a greater size and volume than in the case of brush motors, cooling becomes increasingly important, with the resultant need for optimum cooling. The cooling may be realized as passive or active cooling. In the case of passive cooling, the thermal energy is removed by convection. In the case of active cooling, the thermal energy of the components to be cooled is removed with the aid of a cooling system.

In the exemplary embodiments, the cooling system is a fan 49. The fan 49 is integrated in the first motor housing part 18. In the exemplary embodiment in FIG. 2, the fan 48 for cooling the electric motor drive 22 is integrated between the electronically commutated electric motor 26 and the working tool 30. In the exemplary embodiment in FIG. 3, the fan 48 is disposed above the electronically commutated electric motor 26. It is also conceivable, however, for other cooling systems to be used, such as Peltier elements, closed cooling circuits or the like. It is equally conceivable to dispense with the fan, and to realize the cooling, for example, by means of intelligently disposed cooling ribs and/or cooling bodies.

As can be seen in FIG. 3, there is a dust suction device 50 attached to the first housing part 12. The working tool 30 has drilled holes, distributed over its circumference, via which sanding dust produced during the working of the workpiece is sucked into the motor housing 18 by means of a dust fan 51, the dust fan 51 being fixedly connected to the output shaft 24. The sanding dust transported through the drilled holes of the working tool 30 is routed, via the dust suction device 50, into a dust collecting container, not represented.

A switching element, not represented in greater detail, is provided for switching on the battery-operated hand power tool 10. The switching element may be realized, for example, as a biased-off switch. It is also conceivable, however, for the switching element to be realized as a continuous speed-control switch or as an arresting switch.

In the exemplary embodiment, the hand power tool 10 is realized as a battery-operated hand power tool 10. As can be seen in FIGS. 1 and 2, the rechargeable battery 36 is connected to a rear side 58. The battery voltage is in a range of between 7.2 and 14.4 V, but is preferably 10.8 V. The battery voltage values do not take account of battery voltage fluctuations.

The rechargeable battery 36 is composed, in particular, of lithium-ion battery cells. The rechargeable battery 26 in this case comprises one or more rows of battery cells that, in turn, are connected in parallel to each other. Lithium-ion batteries are distinguished by a high energy density and thermal stability, even in the case of high loads, which means high output power. A further major advantage is the low self-discharge, which means that the batteries are ready for use even in the case of long down-times. Ensuing from these advantages are the advantages of the application according to the disclosure, which mean that the battery-operated hand power tool 10 can be of small, compact dimensions, on the one hand, and on the other hand provide high output power.

It is conceivable for a battery voltage indicator to be integrated in the handle region. The battery voltage indicator may be provided to provide a visual indication of the level of the battery voltage. This may be effected by means of a colored LED, a blinking LED, digital indicator elements, LCD and the like.

What is claimed is:

1. A battery-operated hand power tool, comprising:

at least one working tool;

at least one electronically commutated electric motor configured to act upon an output shaft and to drive the working tool;

at least one motor housing part configured to accommodate the electronically commutated electric motor, the electronically commutated electric motor and the output shaft defining a common first axis that is coaxial with the output shaft; and at least one handle region that is configured to accommodate at least one set of electronics configured to energize the electronically commutated electric motor, wherein the working tool has a diameter that is between 75 and 150 mm, and wherein a ratio of a length of the battery-operated hand power tool to a height along the first axis of the motor housing part is between 1.8 and 2.2.

2. The battery-operated hand power tool according to claim 1, wherein the handle region has at least one first grip region with a circumference that is between 110 and 200 mm to enable one-handed operation of the battery-operated hand power tool in each working position.

3. The battery-operated hand power tool according to claim 2, further comprising a second grip region disposed on the motor housing part, the second grip region being configured as a knob.

4. The battery-operated hand power tool according to claim 3, wherein a first length defined from an outer casing of the second grip region to a wall of the at least one motor housing part is between 5 and 30 mm.

5. The battery-operated hand power tool according to claim 4, wherein the first length is between 10 and 20 mm.

6. The battery-operated hand power tool according to claim 2, wherein the circumference of the at least one first grip region is between 150 and 175 mm.

7. The battery-operated hand power tool according to claim 1, wherein the electronically commutated electric motor drives a carrier shaft.

8. The battery-operated hand power tool according to claim 1, wherein the electronically commutated electric motor is configured as an internal-rotor motor.

9. The battery-operated hand power tool according to claim 1, further comprising at least one fan disposed in the first housing part, the fan being integrated between the electronically commutated electric motor and a receiver of the working tool.

10. The battery-operated hand power tool according to claim 1, further comprising at least one dust suction device integrated in the first housing part.

11. The battery-operated hand power tool according to claim 1, wherein the battery-operated hand power tool is configured as an eccentric sander, and wherein the diameter of the working tool is between 115 and 125 mm.

12. The battery-operated hand power tool according to claim 1, wherein the ratio of the length of the battery-operated hand power tool to the height along the first axis of the motor housing part is 2.0.

13. A battery-operated hand power tool, comprising:

at least one working tool;

at least one electronically commutated electric motor configured to act upon an output shaft and to drive the working tool;

at least one motor housing part configured to accommodate the electronically commutated electric motor, the electronically commutated electric motor and the output shaft defining a common first axis that is coaxial with the output shaft; and at least one handle region that is configured to accommodate at least one set of electronics configured to energize the electronically commutated electric motor, wherein the working tool has a diameter that is between 75 and 150 mm, and wherein a ratio of a length of the battery-operated hand power tool to a diameter of the working tool is between 1.2 and 2.8.

14. The battery-operated hand power tool according to claim 13, wherein the ratio of the length of the battery-operated hand power tool to the diameter of the working tool is between 1.4 and 1.8.

15. A battery-operated hand power tool, comprising:

at least one working tool;

at least one electronically commutated electric motor configured to act upon an output shaft and to drive the working tool;

at least one motor housing part configured to accommodate the electronically commutated electric motor, the electronically commutated electric motor and the output shaft defining a common first axis that is coaxial with the output shaft; and at least one handle region that is configured to accommodate at least one set of electronics configured to energize the electronically commutated electric motor, wherein the working tool has a diameter that is between 75 and 150 mm, and wherein a ratio of the diameter of the working tool to a diameter of the electronically commutated electric motor is less than or equal to 4.0.

16. The battery-operated hand power tool according to claim 15, wherein a ratio of a height along the first axis of the motor housing part to a diameter of the working tool is less than or equal to 1.15.

17. The battery-operated hand power tool according to claim 16, wherein the height of the motor housing part along the first axis is between 90 and 135 mm.

18. The battery-operated hand power tool according to claim 17, wherein the height of the motor housing part along the first axis is between 105 and 110 mm.

19. The battery-operated hand power tool according to claim 16, wherein the ratio of the height along the first axis of the motor housing part to the diameter of the working tool is less than 0.9.

* * * * *